US010178460B2

(12) United States Patent
Jou et al.

(10) Patent No.: US 10,178,460 B2
(45) Date of Patent: Jan. 8, 2019

(54) EARPHONE

(71) Applicant: Merry Electronics(Shenzhen) Co., Ltd., Guangdong (CN)

(72) Inventors: Hung-Uei Jou, Taichung (TW); Chan-Tsung Tsai, Taichung (TW); Chung-Yi Huang, Taichung (TW)

(73) Assignee: Merry Electronics(Shenzhen) Co., Ltd., Guangdong (CN)

( * ) Notice: Subject to any disclaimer, the term of this patent is extended or adjusted under 35 U.S.C. 154(b) by 0 days.

(21) Appl. No.: 15/488,526

(22) Filed: Apr. 17, 2017

(65) Prior Publication Data

US 2018/0115813 A1 Apr. 26, 2018

(30) Foreign Application Priority Data

Oct. 20, 2016 (TW) ..... 105133846 A

(51) Int. Cl.
*H04R 1/10* (2006.01)

(52) U.S. Cl.
CPC ..... *H04R 1/1016* (2013.01); *H04R 1/1058* (2013.01)

(58) Field of Classification Search
CPC .. H04R 1/1018; H04R 1/1053; H04R 25/652; H04R 25/658; H04R 2225/77; H04R 2460/15; H04R 2201/105
USPC ..... 381/320–324; 181/129, 130
See application file for complete search history.

(56) References Cited

U.S. PATENT DOCUMENTS

2003/0081805 A1* 5/2003 Fushimi ..... H04R 1/1016 381/325
2013/0004011 A1 1/2013 Hayashida et al.
2016/0261942 A1* 9/2016 Hayden ..... H04R 1/105

OTHER PUBLICATIONS

Office Action of Taiwan Counterpart Application, dated Sep. 25, 2018, pp. 1-6.

* cited by examiner

*Primary Examiner* — Sunita Joshi
(74) *Attorney, Agent, or Firm* — JCIPRNET

(57) ABSTRACT

An earphone including a housing, a speaker and an eartip is provided. The housing has an accommodating space and a first sound outlet communicated with each other. The speaker is disposed in the accommodating space. The eartip is assembled to the housing. The eartip has a second sound outlet and an incline extension surface. The incline extension surface is configured to fit into a cavum of a user's auricle and withstand an antihelix of the user's auricle.

13 Claims, 4 Drawing Sheets

EARPHONE

CROSS-REFERENCE TO RELATED APPLICATION

This application claims the priority benefit of Taiwan application serial no. 105133846, filed on Oct. 20, 2016. The entirety of the above-mentioned patent application is hereby incorporated by reference herein and made a part of this specification.

BACKGROUND OF THE INVENTION

Field of the Invention

The invention relates to an audio playback device, and particularly relates to an earphone.

Description of Related Art

Along with the continuous improvement of technology, all of electronic products have been developed with a tendency to become lighter and more miniaturized, and the electronic products like smartphone, tablet computer, or notebook, etc., have become indispensable in daily life of human beings. For each of those aforementioned electronic products, in order to allow a user/listener to listen to the audio information provided by the electronic product without disturbing the other people around, an earphone has become a necessary accessory to the electronic product. Moreover, the earphone also provides a better audio transmission to the listener so that the listener can clearly hear and understand the content of the audio information, and especially, unlike the an unclear audio transmission through the air, the audio transmission of the earphone is not be affected while the listener is moving, such as exercising, driving, engaging in intense movements or being in a noisy environment.

Conventionally, there are two types of earphone: in-ear earphone and oblique sound outlet earphone, as shown in FIG. 1 and FIG. 2 respectively. Referring to FIG. 1, the in-ear earphone is an earphone that may be placed into the cavum of the user's ear. In order to place the in-ear earphone into the cavum of the user's ear, a speaker 12 disposed in a housing 10 of the in-ear earphone and configured to produce sound must be manufactured to be very small in size. However, the performance of the speaker 12 having exceedingly small size is poor when generating low frequency sound. Even if the airtightness of the in-ear earphone is improved by an eartip 14 made of soft material in order to improve the performance of the speaker 12 when producing low frequency sound, because the ear canal in the ear is narrow, the total thickness of both the housing 10 and the eartip 14 superimposed on the housing 10 will cause a substantial pressure in the user's ear. Hence, the user will feel a sense of pressure or blockage in the ear while wearing the in-ear earphone and will feel uncomfortable. In addition, as shown in FIG. 2, the oblique sound outlet earphone is an earphone having a sound output surface S' and a center line L' of a sound outlet 24 of a speaker 22 located in a housing 20 not perpendicular to each other. In other words, an orthogonal projection P' of the sound outlet 24 onto a plane containing the sound output surface S' is not located within the sound output surface S'. The size of the speaker 22 in the oblique sound outlet earphone may be designed to be bigger, and the performance of the speaker 22 when generating low frequency sound is better. However, since the orthogonal projection P' of the sound outlet 24 onto the plane containing the sound output surface S' of the speaker 22 is not located within the sound output surface S', the high frequency sound having shorter wavelength and generated by the speaker 22 is reflected multiple times inside the oblique sound outlet earphone, and the performance of the speaker 22 when generating high frequency sound is poor.

SUMMARY OF THE INVENTION

The invention provides an earphone, having an improved performance when generating low and high frequency sound, thereby reducing an oppressive feeling in the ear of the user.

The earphone of the invention includes a housing, a speaker, and an eartip. The housing has an accommodating space and a first sound outlet communicated with each other. The speaker is disposed in the accommodating space. The eartip is assembled to the housing. The eartip has a second sound outlet and an incline extension surface. The incline extension surface is configured to fit into a cavum of a user's auricle and withstand an antihelix of the user's auricle.

In one embodiment of the invention, orthogonal projections of the first sound outlet and the second sound outlet corresponding to a sound output surface of the speaker are located on the sound outlet surface.

In one embodiment of the invention, the distance from the second sound outlet to the sound output surface of the speaker is greater than or equal to 12 millimeters.

In one embodiment of the invention, an included angle between the incline extension surface and the sound output surface of the speaker is from 25 degrees to 65 degrees.

In one embodiment of the invention, the included angle between the incline extension surface and the sound output surface of the speaker is 45 degrees.

In one embodiment of the invention, the orthogonal projections of the first sound outlet and the second sound outlet corresponding to the sound output surface of the speaker overlap with each other.

In one embodiment of the invention, the second sound outlet is located on a side of the incline extension surface and configured to withstand an opening of the ear canal of the user's auricle, and another side of the incline extension surface far away from the second sound outlet is configured to withstand the antihelix.

In one embodiment of the invention, the housing includes a body portion and a tubular portion connected with each other. The speaker is disposed in the accommodating space of the body portion and faces the tubular portion. The first sound outlet is located on a side of the tubular portion far away from the speaker.

In one embodiment of the invention, a center line of the tubular portion is perpendicular to the sound output surface of the speaker.

In one embodiment of the invention, the eartip is assembled to the tubular portion.

In one embodiment of the invention, the eartip includes a hard portion and a soft portion bond with each other. The hard portion is assembled to the housing. The incline extension surface and the second sound outlet are formed by the soft portion.

In one embodiment of the invention, the incline extension surface comprises a contour line, the contour line is configured to be accommodated within cavum of a user's auricle.

In one embodiment of the invention, the incline extension surface is configured to be closely attached to cavum of a user's auricle.

Based on the above, in the invention, since the incline extension surface of the eartip is fitted into the cavum of the user's ear and withstand the antihelix, the eartip can be configured to support the earphone located at the user's ear. Therefore, most of the structure of the housing and the speaker located in the housing can be disposed outside of the user's ear. Because of the aforementioned design, except that the earphone has a good air tightness to achieve a good performance when generating low frequency sound, the earphone can also prevent uncomfortable feeling from generating in the ear of the user because of the sense of pressure or blockage. Otherwise, in the invention, the orthogonal projections of the first sound outlet and the second sound outlet corresponding to the sound output surface of the speaker are located on the sound outlet surface, so a direction of the sound generated by the speaker and passing through the first sound outlet and the second sound outlet substantially faces the ear canal of the ear, thereby reducing the loss of the high frequency sound.

In order to make the aforementioned and other features and advantages of the invention more comprehensible, embodiments accompanying figures are described in detail below.

DESCRIPTION OF THE EMBODIMENTS

Figure 1:
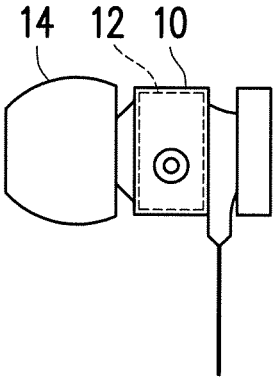
FIG. 1 (PRIOR ART)
FIG. 1 is a cross-sectional schematic view of a conventional earphone.
Figure 2:
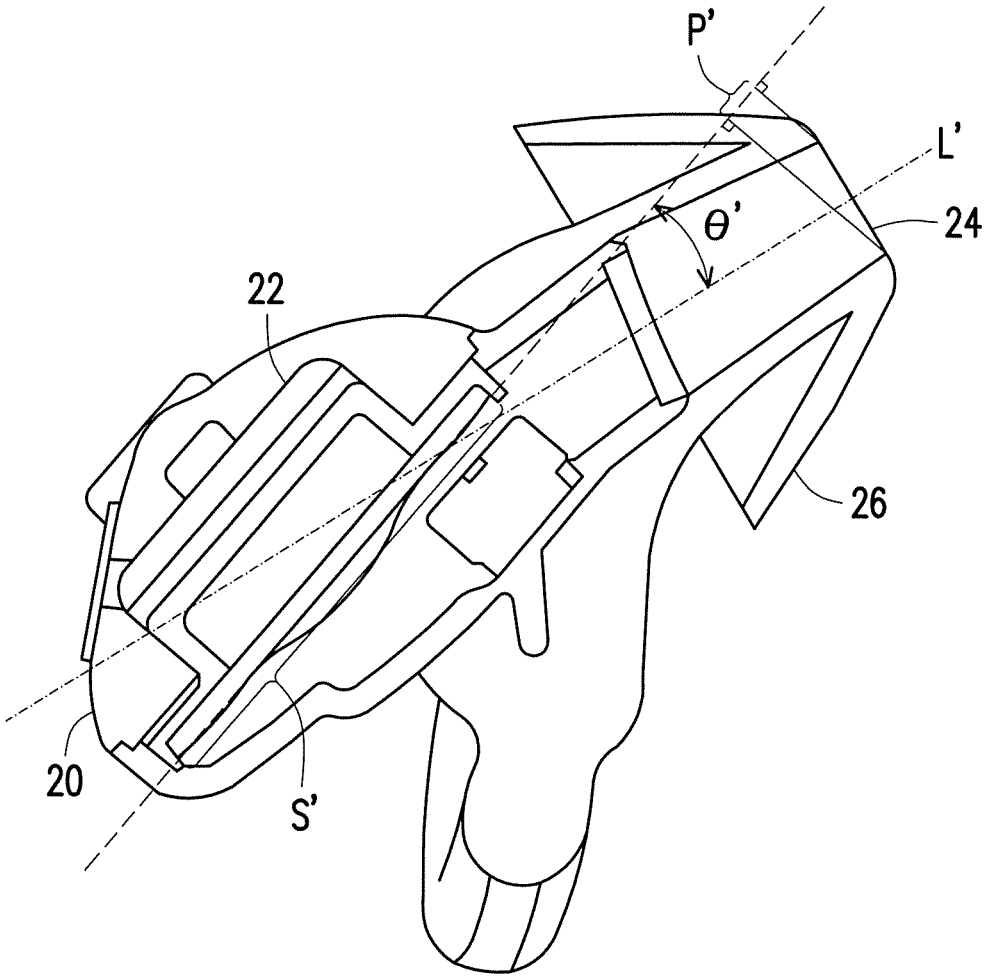
FIG. 2 (PRIOR ART)
FIG. 2 is a cross-sectional schematic view of another conventional earphone.
Figure 3:
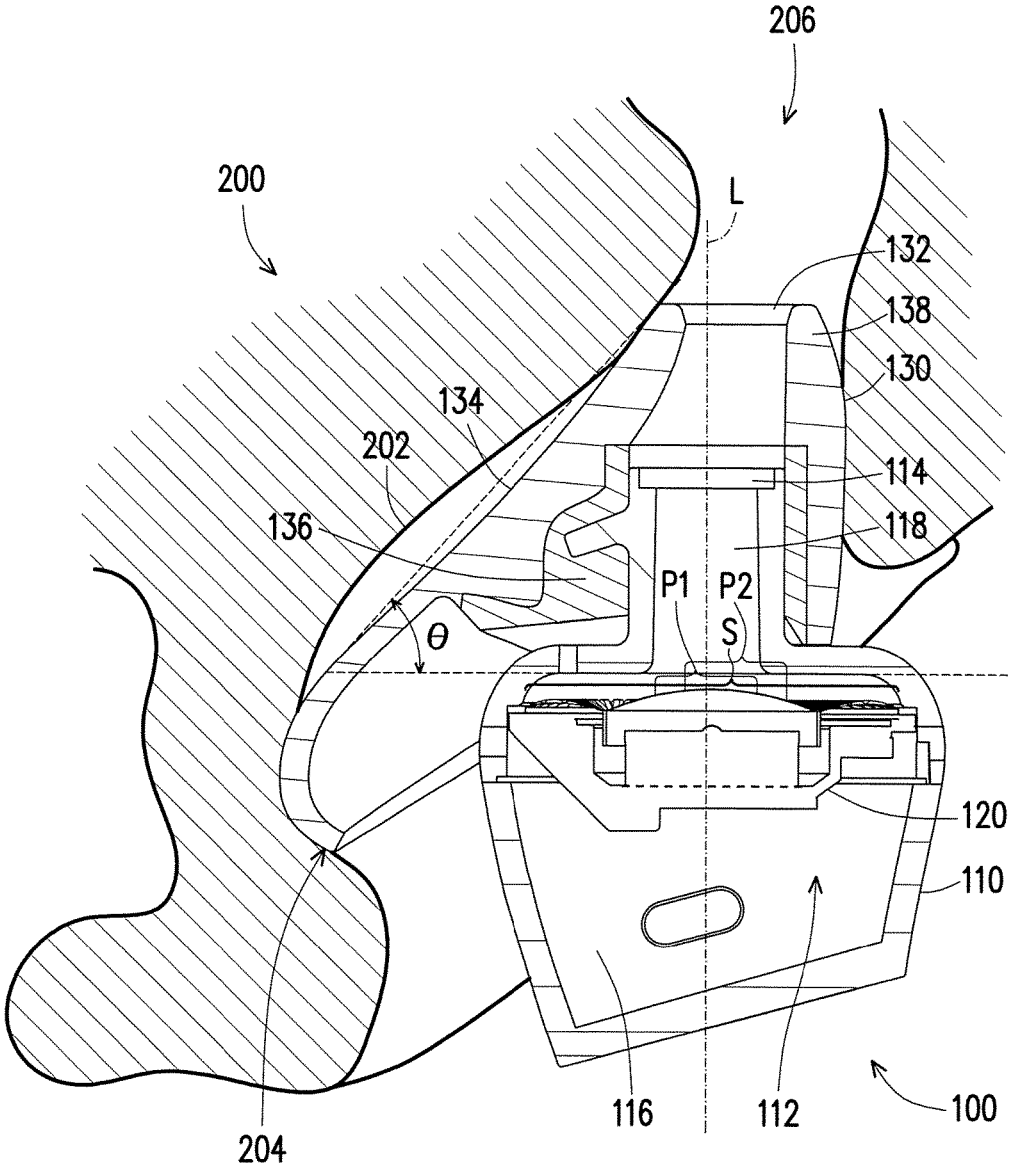
FIG. 3 is a partial cross-sectional view depicting relative position between an earphone according to one embodiment of the invention and an ear.

FIG. 3 is a partial cross-sectional view depicting relative position between an earphone according to one embodiment of the invention and an ear. Referring to FIG. 3, an earphone 100 of the present embodiment includes a housing 110, a speaker 120, and an eartip 130. The housing 110 has an accommodating space 112 and a first sound outlet 114 communicated with each other. The speaker 120 is disposed in the accommodating space 112. The eartip 130 is assembled to the housing 110, wherein the eartip 130 has a second sound outlet 132 and an incline extension surface 134, the incline extension surface 134 is configured to fit into a cavum 202 of an auricle of the user's ear 200 and withstand an antihelix 204. Orthogonal projections P1 and P2 of the first sound outlet 114 and the second sound outlet 132 corresponding to a sound output surface S of the speaker 120 are located on the sound outlet surface S.

In the present embodiment, since the incline extension surface 134 of the eartip 130 is configured to fit into the cavum 202 of the user's auricle and withstand the antihelix 204, the eartip 130 can be used to support the earphone 100 located at the user's ear 200. Therefore, most of the structure of the housing 110 and the speaker 120 located in the housing 110 can be disposed outside of the user's ear 200. Based on the above, compared to the conventional technology that the speaker is disposed inside the user's ear, the speaker 120 of the present embodiment can have a larger volume and have a better low frequency performance so the quality of the sound generated from the speaker 120 is improved. In addition, most of the structure of the housing 110 is disposed outside of the user's ear 200, so as to avoid oppressing the user's ear 200 and to prevent discomfort feeling from generating. Moreover, because the eartip 130 of the present embodiment has the incline extension surface 134, a contact area between the eartip 130 and the inner of the user's ear 200 can be increased. Hence, the earphone 100 has a good air tightness to prevent leaking of the sound generated by the speaker 120. Further, the pressure applied to the user's ear 200 by the earphone 100 can be dispersed so as to enhance the comfort of wearing the earphone 100.

Otherwise, in the present embodiment, the orthogonal projections P1 and P2 of the first sound outlet 114 and the second sound outlet 132 of the earphone 100 corresponding to the sound output surface S of the speaker 120 are located on the sound outlet surface S. Therefore, a direction of the sound generated by the speaker 120 and passing through the first sound outlet 114 and the second sound outlet 132 substantially faces the ear canal 206 of the ear 200 to prevent the sound from being reflected multiple times inside the earphone 100 and the user's ear 200, so as to reduce loss of the high frequency sound and provide a higher fidelity.

In the present embodiment, a distance from the second sound outlet 132 to the sound output surface S of the speaker 120 is greater than or equal to 12 millimeters. This design can ensure that most of the structure of the housing 110 and the speaker 120 disposed in the housing 110 are disposed outside of the user's ear 200, so as to avoid oppressing the user's ear 200, to prevent discomfort feeling from generating, and to increase the volume of the speaker 120 as well.

In the present embodiment, an included angle θ between the incline extension surface 134 of the eartip 130 and the sound output surface S of the speaker 120 is from 25 degrees to 65 degrees, such as 45 degrees. When the included angle θ exists, the contact portion between the incline extension surface 134 of the eartip 130 and the inner of the user's ear 200 is larger, so the earphone 100 has a good air tightness to enhance the comfort of wearing the earphone 100.

In the present embodiment, the orthogonal projections P1 and P2 of the first sound outlet 114 and the second sound outlet 132 corresponding to the sound output surface S of the speaker 120 overlap with each other. Therefore, a direction of the sound generated by the speaker 120 and passing through the first sound outlet 114 and the second sound outlet 132 faces the ear canal 206 to prevent the sound from being reflected too many times inside the earphone 100 and the user's ear 200, so as to reduce loss of the high frequency sound and provide a higher fidelity.

In one embodiment of the invention, the second sound outlet 132 is located on a side of the incline extension surface 134 of the eartip 130 and configured to withstand an opening of the ear canal 206 of the user's auricle, and another side of the incline extension surface 134 of the eartip 130 far away from the second sound outlet 132 is configured to withstand the antihelix 204. Since the second sound outlet 132 of the eartip 130 is located at the opening of the ear canal 206 of the user's auricle, the eartip 130 does not penetrate deep into the ear canal 206 of the user's ear 200. Therefore, the ear canal 206 of the user's ear 200 will not be oppressed and will not generate discomfort feeling. Otherwise, the aforementioned design of the incline extension surface 134 of the eartip 130 can ensure that the eartip 130 can be used to support the earphone 100 located at the user's ear 200.

In the present embodiment, the housing 110 includes a body portion 116 and a tubular portion 118 connected with each other, the speaker 120 is disposed in the accommodating space 112 of the body portion 116 and faces the tubular portion 118, and the first sound outlet 114 is located on a side of the tubular portion 118 far away from the speaker 120. In other words, the speaker 120 is disposed on a side of the tubular portion 118 relatively far from the internal of the ear 200, and the sound generated from the speaker 120 is collected by the tubular portion 118 and is transmitted to the internal of the ear 200. A center line L of the tubular portion 118 is perpendicular to the sound output surface S, so most of the sound generated by the speaker 120 can directly enter the tubular portion 118 so as to avoid loss. The eartip 130 is assembled to the tubular portion 118 to serve as a cushioning component between the tubular portion 118 and the ear canal 206. In the present embodiment, the eartip 130 includes a hard portion 136 and a soft portion 138 bond with each other, the hard portion 136 is assembled to the housing 110 so as to have better bonding strength, and the incline extension surface 134 and the second sound outlet 132 are formed by the soft portion 138. The body portion 116 and the tubular portion 118 of the housing 110 in the present embodiment are integrally formed, so the entire structure of the housing 110 is simple and easy in assembly. Otherwise, the material of the housing 110 is selected from materials having great rigidity. Since the body portion 116 and the a part of the tubular portion 118 of the housing 110 are disposed outside of the user's ear 200 and the soft portion 138 of the eartip 130 is disposed between the other part of the tubular portion 118 of the housing 110 and the user's ear 200, so the housing 110 can be prevented from oppressing the user's ear 200 and causing discomfort feeling. Moreover, since the center line L of the tubular portion 118 of the housing 110 is perpendicular to the sound output surface S, the direction of the sound generated from the speaker 120 and passing through the first sound outlet 114 can be ensured to substantially directly face the ear canal 206.

In addition, in the present embodiment, the hard portion 136 and the soft portion 138 of the eartip 130 are simultaneously formed by double injection molding technology, so the hard portion 136 and the soft portion 138 are tightly bond and not easily separated. The material with great rigidity is selected to be the material of the hard portion 136 of the eartip 130, so the eartip 130 and the housing 110 are tightly interlocked when assembling so as to avoid loosening.

Figure 4:
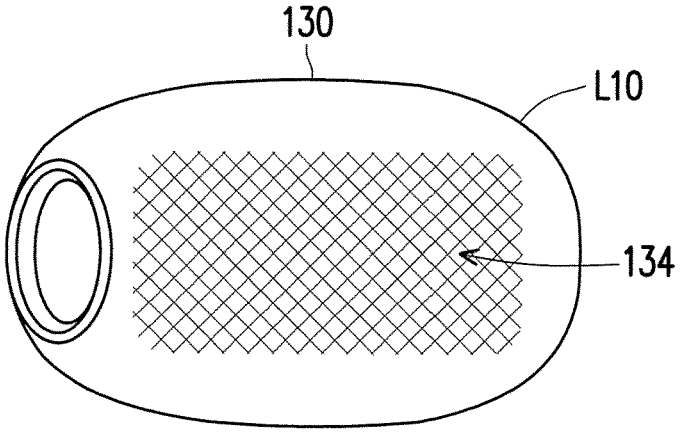
FIG. 4 is a front view of the eartip of the earphone of FIG. 3.
Figure 5:
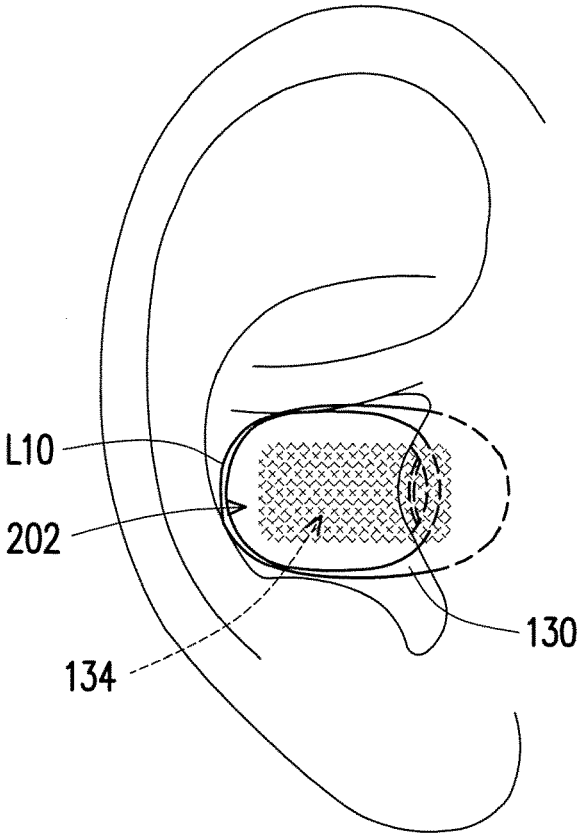
FIG. 5 is a schematic view depicting relative position between the eartip of the earphone of FIG. 3 and an ear.

FIG. 4 is a front view of the eartip of the earphone of FIG. 3, and FIG. 5 is a schematic view depicting relative position between the eartip of the earphone of FIG. 3 and an ear. Referring to FIGS. 4 and 5, the incline extension surface 134 is shown in the rear view of the eartip 130, and the incline extension surface 134 comprises a contour line L10. When the eartip 130 is fit into the user's auricle, the contour line L10 is accommodated within cavum 202 of a user's auricle. Therefore, the eartip 130 can be stably fit within cavum 202. In FIG. 5, the rear view of the eartip 130 is shown, so that the incline extension surface 134 which faces toward the surface of the cavum 202 is hidden. Referring to FIGS. 3 and 5, when the eartip 130 is fit into the user's auricle, the incline extension surface 134 is closely attached to cavum 202 of a user's auricle. Hence, the eartip 130 provides a good air tightness to prevent leaking of the sound generated by the speaker. Further, the pressure applied to the user's auricle by the eartip 130 can be dispersed so as to enhance the comfort of wearing the earphone.

In summary, based on the aforementioned design in the invention, since the incline extension surface of the eartip is fitted into the cavum of the user's ear and withstand the antihelix, the eartip can be configured to support the earphone located at the user's ear. Therefore, most of the structure of the housing and the speaker located in the housing can be disposed outside of the user's ear. Based on the above, the speaker of the invention can be configured to have a larger volume and have a better low frequency performance, so the quality of the sound generated from the speaker is improved. In addition, since most of the structure of the housing made of material having great rigidity is disposed outside of the user's ear and the second sound outlet of the eartip is located at the opening of the ear canal of the user's auricle, the eartip does not penetrate deep into the ear canal of the user's ear. Therefore, the ear canal of the user's ear will not be oppressed and will not generate discomfort feeling. Further, because the eartip is designed to have the incline extension surface, the contact area between the eartip and the inner of the user's ear can be increased. Hence, the earphone has a good air tightness to prevent leaking of the sound generated by the speaker and to enhance the comfort of wearing the earphone. Otherwise, in the invention, the orthogonal projections of the first sound outlet and the second sound outlet corresponding to the sound output surface of the speaker are located on the sound outlet surface, so the direction of the sound generated by the speaker and passing through the first sound outlet and the second sound outlet substantially faces the ear canal of the ear. Therefore, the sound is prevented from being reflected too many times inside the earphone and the user's ear, so as to reduce loss of the high frequency sound.

Although the invention has been disclosed with reference to the aforesaid embodiments, they are not intended to limit the invention. It will be apparent to one of ordinary skill in the art that modifications and variations to the described embodiments may be made without departing from the spirit and the scope of the invention. Accordingly, the scope of the invention will be defined by the attached claims and not by the above detailed descriptions.

What is claimed is:

1. An earphone, comprising:

a housing, having an accommodating space and a first sound outlet communicated with each other;

a speaker, disposed in the accommodating space;

an eartip, assembled to the housing, wherein the eartip has a second sound outlet and an incline extension surface, the incline extension surface is configured to fit into a cavum of a user's auricle and withstand an antihelix of the user's auricle.

2. The earphone as recited in claim 1, wherein orthogonal projections of the first sound outlet and the second sound outlet corresponding to a sound output surface of the speaker are located on the sound outlet surface.

3. The earphone as recited in claim 1, wherein a distance from the second sound outlet to a sound output surface of the speaker is greater than or equal to 12 millimeters.

4. The earphone as recited in claim 1, wherein an included angle between the incline extension surface and a sound output surface of the speaker is from 25 degrees to 65 degrees.

5. The earphone as recited in claim 1, wherein an included angle between the incline extension surface and a sound output surface of the speaker is 45 degrees.

6. The earphone as recited in claim 2, wherein the orthogonal projections of the first sound outlet and the second sound outlet corresponding to the sound output surface of the speaker overlap with each other.

7. The earphone as recited in claim 1, wherein the second sound outlet is located on a side of the incline extension surface and configured to withstand an opening of an ear canal of the user's auricle, and another side of the incline extension surface far away from the second sound outlet is configured to withstand the antihelix.

8. The earphone as recited in claim 1, wherein the housing comprises a body portion and a tubular portion connected with each other, the speaker is disposed in the accommodating space of the body portion and faces the tubular portion, and the first sound outlet is located on a side of the tubular portion far away from the speaker.

9. The earphone as recited in claim 8, wherein a center line of the tubular portion is perpendicular to a sound output surface of the speaker.

10. The earphone as recited in claim 8, wherein the eartip is assembled to the tubular portion.

11. The earphone as recited in claim 1, wherein the eartip comprises a hard portion and a soft portion bond with each other, the hard portion is assembled to the housing, and the incline extension surface and the second sound outlet are formed by the soft portion.

12. The earphone as recited in claim 1, wherein the incline extension surface comprises a contour line, the contour line is configured to be accommodated within cavum of a user's auricle.

13. The earphone as recited in claim 1, wherein the incline extension surface is configured to be closely attached to cavum of a user's auricle.

* * * * *